US011805958B2

(12) United States Patent
Kim

(10) Patent No.: US 11,805,958 B2
(45) Date of Patent: Nov. 7, 2023

(54) MULTIFUNCTIONAL PUSH-PULL MOP

(71) Applicant: Je Hun Kim, Daegu (KR)

(72) Inventor: Je Hun Kim, Daegu (KR)

( * ) Notice: Subject to any disclaimer, the term of this patent is extended or adjusted under 35 U.S.C. 154(b) by 0 days.

(21) Appl. No.: 17/606,161

(22) PCT Filed: May 27, 2019

(86) PCT No.: PCT/KR2019/006295

§ 371 (c)(1),
(2) Date: Oct. 25, 2021

(87) PCT Pub. No.: WO2020/218668

PCT Pub. Date: Oct. 29, 2020

(65) Prior Publication Data

US 2022/0192457 A1 Jun. 23, 2022

(30) Foreign Application Priority Data

Apr. 26, 2019 (KR) ..... 10-2019-0048898

(51) Int. Cl.
*A47L 13/256* (2006.01)
*A47L 13/258* (2006.01)

(52) U.S. Cl.
CPC ..... *A47L 13/256* (2013.01); *A47L 13/258* (2013.01)

(58) Field of Classification Search
CPC ..... A47L 13/254–258; A47L 9/0009–0063; A47L 9/066; A47L 13/52; A47L 13/225; A47L 13/20–26
USPC ..... 15/228, 229.7, 229.8, 229.4
See application file for complete search history.

(56) References Cited

U.S. PATENT DOCUMENTS 2,164,407 A * 7/1939 Jarchow ..... A47L 13/52 15/257.3
2012/0222227 A1* 9/2012 Johnson ..... A47L 11/4036 15/105
2017/0143179 A1 5/2017 Taylor et al.

FOREIGN PATENT DOCUMENTS

CN 107456175 A * 12/2017
KR 20-0376049 Y1 3/2005
KR 10-1147814 B1 5/2012
KR 10-1696816 B1 1/2017
(Continued)

OTHER PUBLICATIONS

Definition for "spring" from Oxford Languages dictionary via Google Search (retrieved Aug. 25, 2022) (Year: 2022).*
(Continued)

*Primary Examiner* — Brian D Keller
*Assistant Examiner* — Steven Huang
(74) *Attorney, Agent, or Firm* — Hauptman Ham, LLP

(57) ABSTRACT

A multifunctional push-pull mop includes a base plate, a support member, and an elastic member. A user can bring the base plate to which a cleaning cloth is attached into close contact with a floor, a wall, a ceiling, or the like, using a small force, and when the user moves the base plate to which the cleaning cloth is attached from a boundary portion between a floor and a wall or between a wall and a ceiling to the floor, wall, or ceiling, the base plate can be rotated by the elastic restoration force of the elastic member to instantly come into close contact with the floor, wall, or ceiling, thereby allowing the user to conveniently move the base plate from the boundary portion of the floor, the wall, the ceiling, or the like, without detaching the base plate therefrom.

6 Claims, 14 Drawing Sheets

(56) References Cited

FOREIGN PATENT DOCUMENTS

| | | | | | |
|---|---|---|---|---|---|
| KR | 10-1753852 | B1 | | 7/2017 | |
| KR | 20170071256 | A | * | 7/2017 | ..... A47L 13/256 |

OTHER PUBLICATIONS

Translation of KR20170071256A (Year: 2017).*
International Search Report issued for corresponding International Patent Application No. PCT/KR2019/006295 dated Jan. 23, 2020, along with an English translation.
Written Opinion issued for corresponding International Patent Application No. PCT/KR2019/006295 dated Jan. 23, 2020, along with an English translation.

* cited by examiner

MULTIFUNCTIONAL PUSH-PULL MOP

CROSS-REFERENCE TO RELATED APPLICATION

The present application is a national stage filing under 35 U.S.C § 371 of PCT application number PCT/KR2019/006295 filed on May 27, 2019 which is based upon and claims the benefit of priority to Korean Patent Application No. 10-2019-0048898, filed on Apr. 26, 2019, in the Korean Intellectual Property Office. Both of the aforementioned applications are hereby incorporated by reference in their entireties.

TECHNICAL FIELD

The present invention relates to a multifunctional push-pull mop, and more particularly, to a multifunctional push-pull mop that is configured to have a base plate, to which a cleaning cloth is attached, rotatable around a support member, thereby allowing the base plate to easily come into close contact with a floor, a wall, a ceiling, or the like, and configured to have an elastic member adapted to improve a degree of tightness of the base plate to the floor, wall, ceiling, or the like.

BACKGROUND ART

Generally, cleaning tools are used to clean living spaces such as houses, offices, and the like and classified into vacuum cleaners that cause suction in order to remove dust or foreign substances from floors, steam cleaners that heat cleaning cloths with steam to easily remove stains from floors, and mops that clean floors by pushing and pulling cleaning cloths attached to the undersides thereof.

Among them, the mop is pushed and pulled through a mop handle, in a state where a cleaning rag or cloth is attached to the underside of a mop body, in order to clean floors, walls, and the like in various places.

A conventional mop with a rag detachably mounted thereonto, as disclosed in Korean Utility Model Registration No. 20-0376049, which has a mop handle having a handle part disposed on the upper portion thereof, a rag support means coupled to the lower end periphery of the mop handle, and a rag coupled to the rag support means, includes: a 'Π'-shaped support having a support plate with a coupling hole formed on the center of top thereof and support rods extended downwards from both ends of the support plate and having rotary shaft protrusions formed on the lower portions of the inner surfaces of the extended ends thereof; a rag plate coupled to the insides of the support rods of the support, having male magic tape surfaces mounted on the top ends of the top and underside surfaces thereof, a plurality of slip prevention protrusions protruding upwardly from the top and underside surfaces thereof, and insertion grooves adapted to insert the rotary shaft protrusions of the support rods thereinto; and a rug adapted to surround the rag plate in such a manner as to allow the inner surfaces of end portions thereof to be detachably coupled to the male magic tape surfaces mounted on the top ends of the top and underside surfaces of the rag plate.

According to the conventional mop, the rag plate rotates around the support so that both surfaces of the rag plate can selectively come into close contact with the floor in order to clean the floor.

However, the conventional mop does not include any separate component for limiting the rotation of the rag plate around the support, so that if the rag plate is separated from the floor and moved to another place after one surface of the rag plate has been used, the debris or foreign surfaces sticking to one surface of the rag plate may fall by the movement, and further, the rag plate has to be inconveniently turned to use the other surface not yet used. To allow the rug plate to be brought into close contact with the floor, besides, a user should continuously apply a given force to the mop, thereby reducing the easiness of use of the mop.

DISCLOSURE

Technical Problem

Accordingly, the present invention has been made in view of the above-mentioned problems occurring in the related art, and it is an object of the present invention to provide a multifunctional push-pull mop that is configured to have connection parts, a base plate rotatably shaft-coupled to the connection parts, and an elastic member connected to the connection parts and the base plate to enable the base plate to be kept parallel to the connection parts by means of an elastic restoration force generated therefrom, so that a user can bring the base plate to which a cleaning cloth is attached into close contact with a floor, a wall, a ceiling, or the like, using a small force, and when the user moves the base plate to which the cleaning cloth is attached, from a boundary portion between a floor and a wall between a wall and a ceiling to the floor, wall, or ceiling, the base plate can rotate by the elastic restoration force of the elastic member to instantly come into close contact with the floor, wall, or ceiling, thereby allowing the user to conveniently move the base plate from the boundary portion of the floor, the wall, the ceiling, or the like, without detaching the base plate therefrom.

Technical Solution

To accomplish the above-mentioned objects, according to the present invention, there is provided a multifunctional push-pull mop including: a base plate configured to allow a cleaning cloth to be selectively detachably attached to one side of outer surfaces thereof; a support member having connection parts extended bent downward from both ends thereof in such a manner as to be coupled to shafts disposed on both ends of the base plate to allow the base plate to be rotatable around the shafts and a handle bar coupled to the top center thereof and grasped by a user; and an elastic member made of an elastic material and connected to the connection parts and the base plate to allow the base plate rotating by means of the shaft-coupling to the connection parts to be kept in parallel to the connection parts by means of an elastic restoration force generated therefrom.

Advantageous Effects

According to the present invention, the multifunctional push-pull mop can perform its inherent purpose for cleaning indoor and outdoor places by means of the attachment of the cleaning cloth thereto, and further, if the mop moves to clean the given places, the base plate to which the cleaning cloth is attached is fixed by means of the elastic member and is thus prevented from rotating around the shafts, thereby allowing the user to easily distinguish the top and underside surfaces of the base plate. Also, if the base plate rotates to come into close contact with the floor, wall, ceiling, or the like through the force applied by the user, the base plate can be firmly brought into close contact with the floor, wall, ceiling, or the like by means of the elastic restoration force of the elastic member, and while the base plate is rotating around the shafts, further, the base plate can easily clean the curved wall or column through the returning force applied from the elastic member thereto, thereby providing many conveniences for the user.

Figure 1:
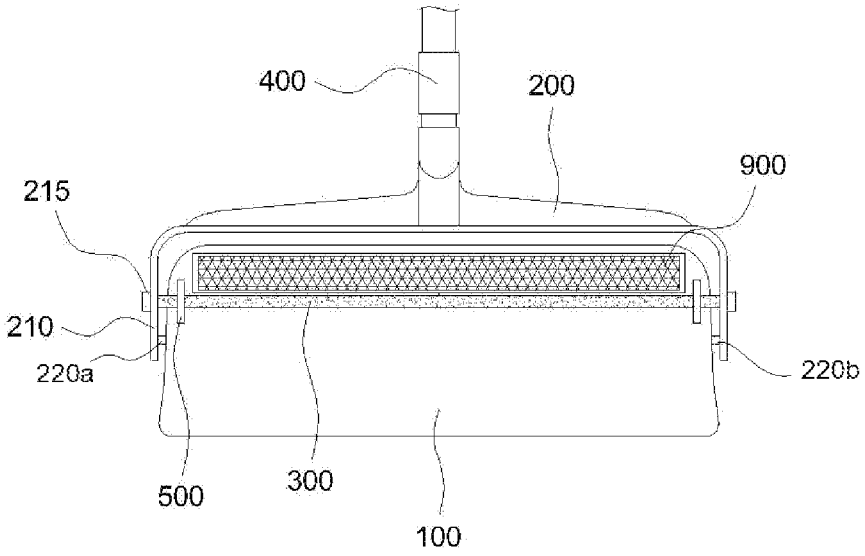
FIG. 1 is a front view showing a multifunctional push-pull mop according to the present invention.

100: Base plate
110: Insertion groove
120: Escape prevention member insertion slot
130: Rail groove
200: Support member
210: Connection part
215: Fixing member
300: Elastic member
400: Handle bar
500: Escape prevention member
600: Auxiliary elastic member
700: Auxiliary cleaning plate
710: Fitting part
800: Winding part
810: Line part
900: Velcro® tape
910: Fitting slit

BEST MODE FOR INVENTION

The present invention provides a multifunctional push-pull mop that is configured to have a base plate, to which a cleaning cloth is attached, rotatable around a support member, thereby allowing the base plate to easily come into close contact with a floor, a wall, a ceiling, or the like, and configured to have an elastic member adapted to improve a degree of tightness of the base plate to the floor, wall, ceiling, or the like.

Hereinafter, an explanation of the configuration and operation of the multifunctional push-pull mop according to the present invention will be given with reference to FIGS. 1 to 14.

Referring first to FIGS. 1 to 5, the multifunctional push-pull mop according to the present invention includes: a base plate 100 configured to allow a cleaning cloth r to be selectively detachably attached to one side of outer surfaces thereof; a support member 200 having connection parts 210 extended bent downward from both ends thereof in such a manner as to be coupled to shafts and 220*b* disposed on both ends of the base plate 100 to allow the base plate 100 to be rotatable around the shafts and 220*b* and a handle bar 400 coupled to the top center thereof and grasped by a user; and an elastic member 300 made of an elastic material and connected to the connection parts 210 and the base plate 100 to allow the base plate 100 rotating by means of the shaft-coupling to the connection parts 210 to be kept in parallel to the connection parts 210 by means of an elastic restoration force generated therefrom.

Under the above-mentioned configuration, the multifunctional push-pull mop according to the present invention will be explained in detail.

First, a conventional general mop includes the base plate 100, the support member 200, and the handle bar 400.

The base plate 100 is plate-shaped and configured to allow the cleaning cloth r to be selectively detachably attached to one side of outer surfaces thereof.

Further, the base plate 100 is shaft-coupled to the connection parts 210 of the support member 200 as will be discussed later and thus rotatable around the shafts.

In this case, the cleaning cloth r may be selected from various cleaning rags, cloths, and dishcloths that are capable of absorbing water to clean floors, walls, and ceilings, and the detachable structure of the cleaning cloth r from the base plate 100 may be selected from various detachable structures used in the conventional practices, such as slit fitting, Velcro taping, and the like.

The support member 200 is spaced apart from top side end of the base plate 100 and formed long in a longitudinal direction, and further, the support member 200 has the connection parts 210 extended bent downward from both side end portions thereof.

Further, the connection parts 210 are shaft-coupled to the centers of both side ends of the base plate 100 to allow the base plate 100 to be rotatable around the shafts.

The handle bar 400 is disposed on the top portion of the support member 200 so that it can be grasped by the user.

In this case, the handle bar 400 is extended integrally from the top portion of the support member 200, and otherwise, the handle bar 400 may be selectively coupled and separated thereto and therefrom.

Under the above-mentioned configuration, the multifunctional push-pull mop according to the present invention includes the elastic member 300, as the most important component of the components constituting the present invention, made of an elastic material and connected to the connection parts 210 and the base plate 100 to allow the base plate 100 rotating through the shaft-coupling to the connection parts 210 to be kept in parallel to the connection parts 210 by means of the elastic restoration force thereof.

In this case, one side of the elastic member 300 is connected to the connection parts 210, and the other side to one side of the base plate 100, so that if an external force larger than the elastic restoration force is applied to the base plate 100, the elastic member 300 becomes expanded to enable the base plate 100 to rotate around the shafts, and if the force applied to the base plate 100 rotating around the shafts disappears, the base plate 100 is returned to its original position by means of the elastic restoration force of the elastic member 300 so that the base plate 100 can be kept in parallel to the connection parts 210.

Further, the elastic member 300 has various shapes such as a string, a band, a spring, and the like, and according to the present invention, the elastic member 300 has the shape of a band. The elastic member 300 is made of various materials with elasticity, such as TPU, metal, synthetic resin, and the like.

In specific, one side of the lower portion of the base plate 100 is pushed to come into close contact with the floor, wall, or ceiling through the user's control of the handle bar 400 connected to the support member 200 to thus allow the base plate 100 to rotate, so that the top or underside surface of the base plate 100 comes into close contact with the floor, wall, or ceiling, and through the elastic restoration force of the elastic member 300, in this case, the base plate 100 can be more firmly brought into close contact with the floor, wall, or ceiling. If the base plate 100 is detached from the floor, wall, or ceiling through the user's control of the handle bar 400, further, the base plate 100 rotates by means of the elastic restoration force of the elastic member 300 and is kept in parallel to the connection parts 210.

Figure 3:
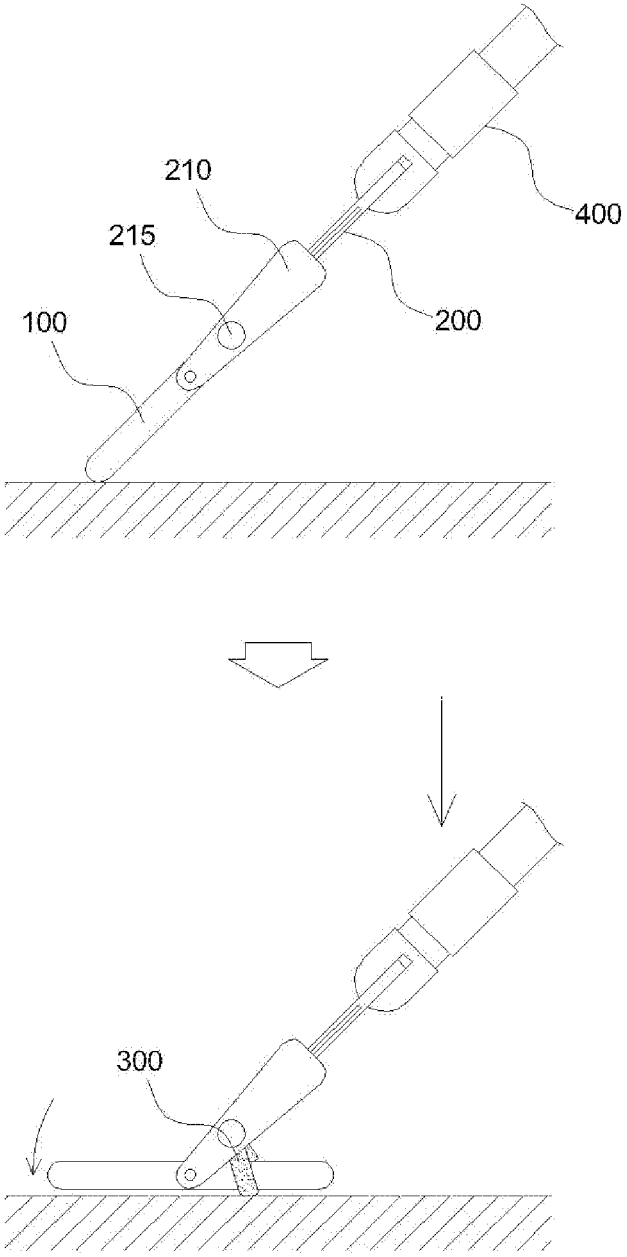
FIG. 3 is an exemplary view showing a use state of the multifunctional push-pull mop according to the present invention.
Figure 4:
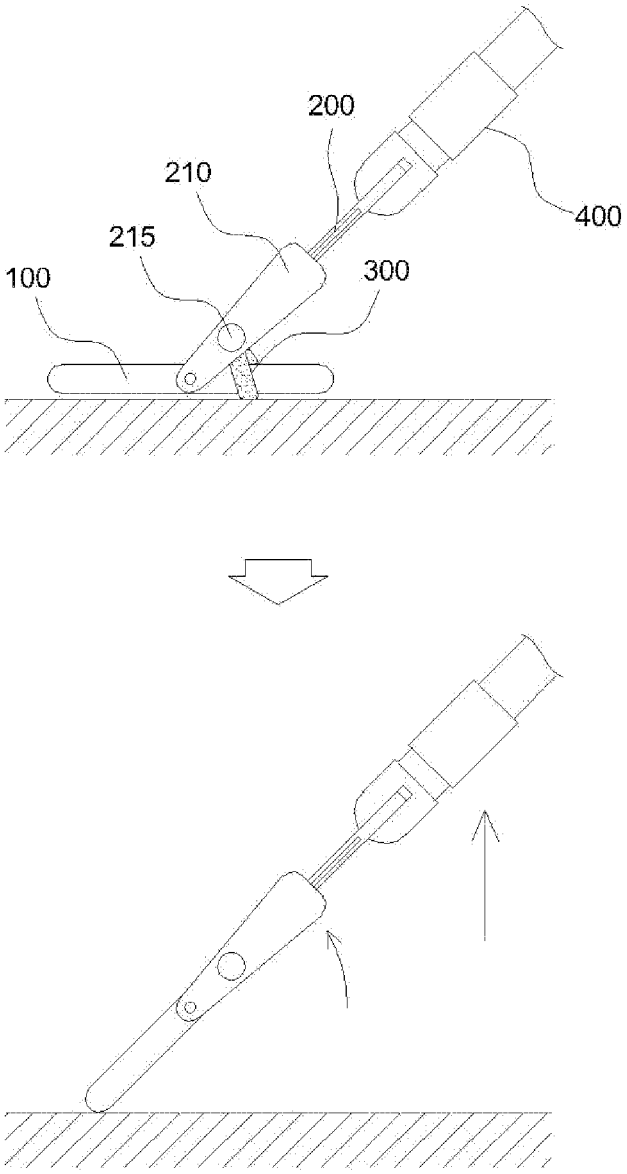
FIG. 4 is an exemplary view showing another use state of the multifunctional push-pull mop according to the present invention.
Figure 5:
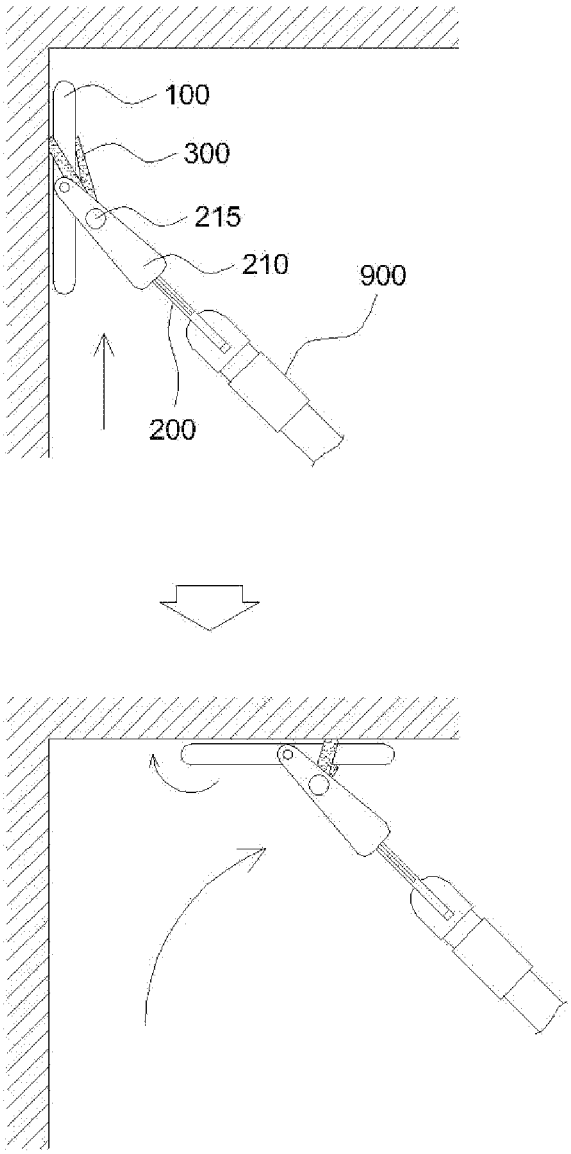
FIG. 5 is an exemplary view showing yet another use state of the multifunctional push-pull mop according to the present invention.

That is, as shown in FIGS. 3, 4, and 5, if the base plate 100 rotates by the user's control to come into close contact with the floor, wall, or ceiling, the base plate 100 can be firmly brought into close contact with the floor, wall, or ceiling by means of the elastic restoration force of the elastic member 300, and as the base plate 100 rotates around the shafts, even a curved wall or column can be easily cleaned using the returned force of the base plate 100 generated through the elastic member 300, thereby providing many conveniences for the user.

Figure 14:
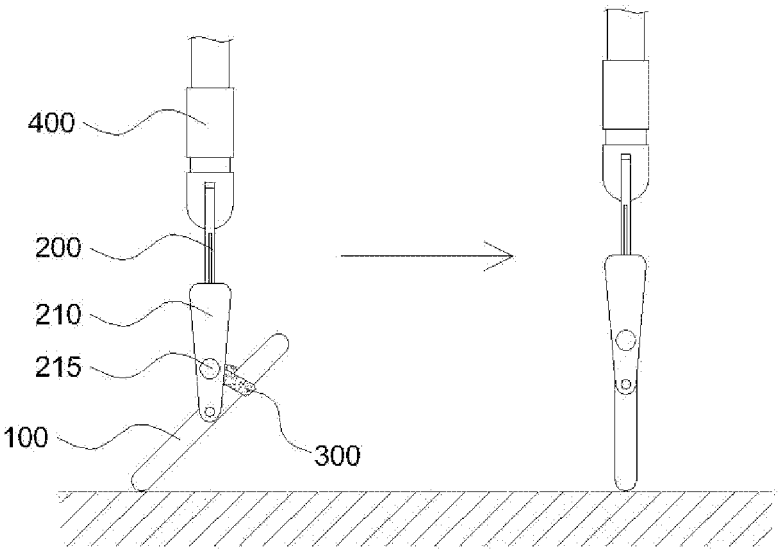
FIG. 14 is a perspective view showing yet another use state of the multifunctional push-pull mop according to the present invention.

With the returned force of the base plate 100 generated through the elastic restoration force of the elastic member 300, as shown in FIG. 14, the multifunctional push-pull mop according to the present invention can be used as a bloom.

Figure 2:
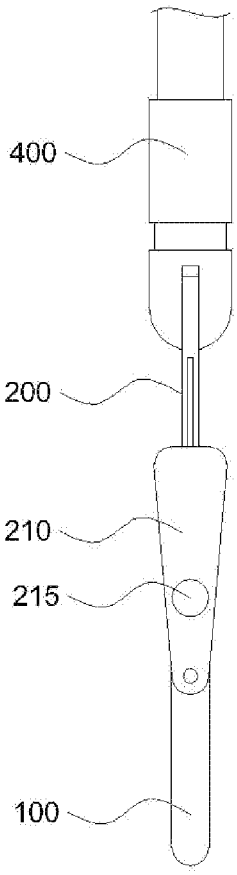
FIG. 2 is a side view showing the multifunctional push-pull mop according to the present invention.
Figure 8:
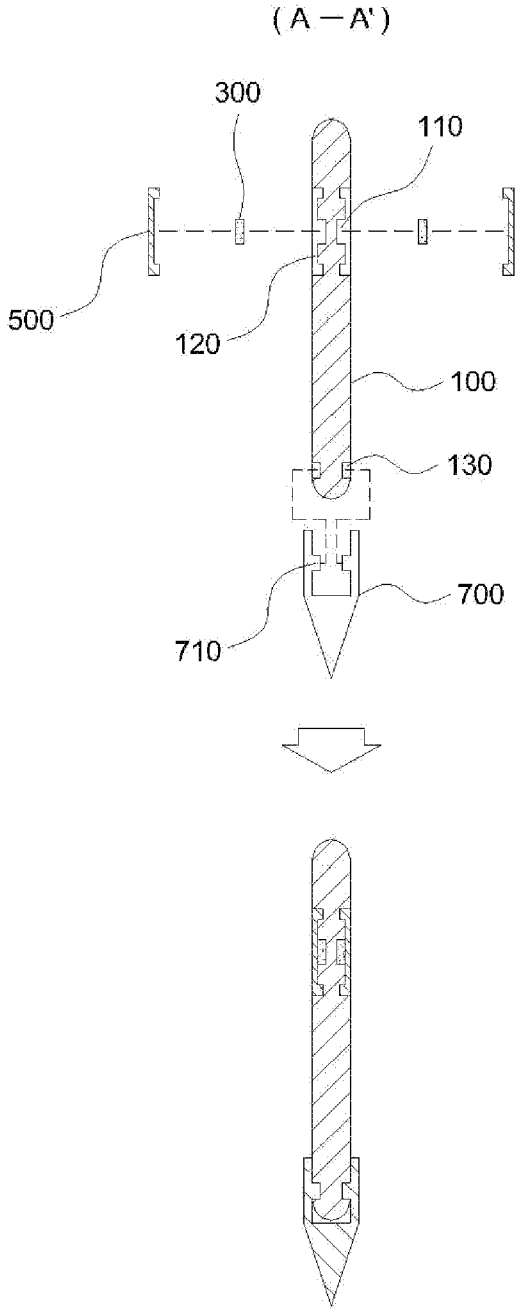
FIG. 8 is a side sectional view taken along the line A-A of FIG. 7.

Further, as shown in FIGS. 1, 2, and 8, the base plate 100 has insertion grooves 110 extended in longitudinal directions on the top and underside surfaces thereof to insert the elastic member 300 thereinto, and the connection parts 210 have fixing members 215 adapted to selectively fix and separate both ends of the elastic member 300 thereto and therefrom, so that the elastic member 300 is inserted into the insertion grooves 110 to surround the top and underside surfaces of the base plate 100, and both ends of the elastic member 300 are fixed to the connection parts 210 by means of the fixing members 215.

In specific, as shown in FIG. 8, the insertion grooves 110 are formed inwardly from the top and underside surfaces of the base plate 100 to allow the elastic member 300 surrounding the top and underside surfaces of the base plate 100 to be completely inserted thereinto, without protruding therefrom, so that the cleaning cloth r detachably attached to the top and underside surfaces of the base plate 100 can be prevented from getting loose by the elastic member 300.

Further, the fixing members 215 are inserted into the insertion grooves 110 to allow both ends of the elastic member 300 surrounding the top and underside surfaces of the base plate 100 to be selectively fixed and separated to and from the connection parts 210.

In specific, if the elastic restoration force of the elastic member 300 is reduced due to long-term use, the elastic member 300 can be easily exchanged with new one by means of the fixing members 215.

The elastic member 300 is inserted into the insertion grooves 110 to surround the top and underside surfaces of the base plate 100, and both ends of the elastic member 300 are fixed to the connection parts 210 by means of the fixing members 215.

Further, as shown in FIGS. 1, 2, and 8, escape prevention members 500 are disposed on one side of the respective insertion grooves 110 to prevent the elastic member 300 inserted into the insertion grooves 110 from escaping outwardly from the insertion grooves 110.

In this case, the escape prevention members 500 are desirably inserted into escape prevention member insertion slots 120 extended up and down from one side of the insertion grooves 110 so that the escape prevention members 500 can be prevented from being exposed to the outside of the base plate 100, thereby avoiding the cleaning cloth r detachably attached to the top and underside surfaces of the base plate 100 from getting loose by the escape prevention members 500.

In specific, the escape prevention members 500 serve to prevent the elastic member 300 from escaping from the insertion grooves 110 due to external reasons.

Figure 6:
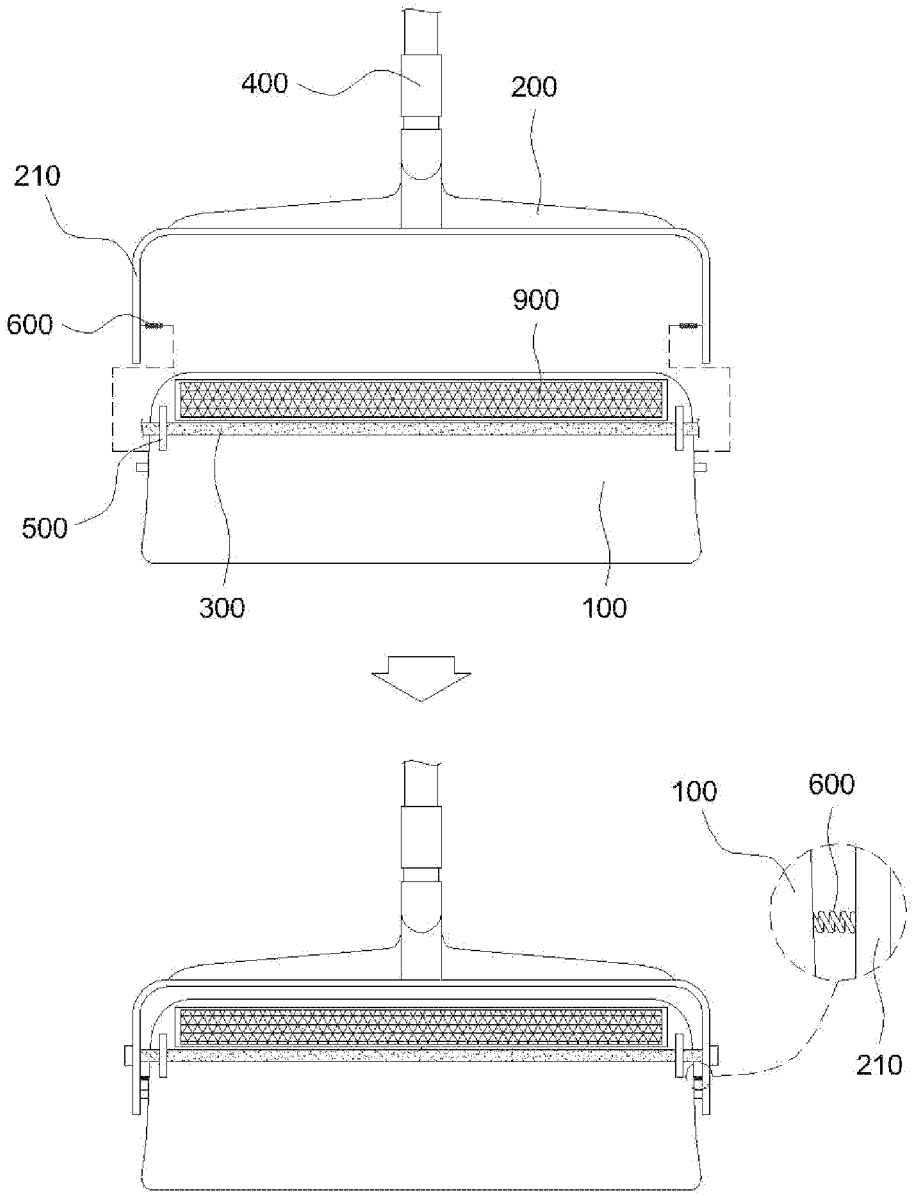
FIG. 6 is an exploded view showing the multifunctional push-pull mop according to the present invention that further includes an auxiliary elastic member.

Further, as shown in FIG. 6, the multifunctional push-pull mop according to the present invention includes spring-shaped auxiliary elastic members 600 made of an elastic material, connected to the connection parts 210 on one side thereof, and connected to the base plate 100 on the other side thereof, so that the base plate 100 rotating through the shaft-coupling to the connection parts 210 can be kept in parallel to the connection parts 210 by means of the elastic restoration forces generated therefrom.

In specific, the spring-shaped auxiliary elastic members 600 are connected to the connection parts 210 on one side thereof and connected to the base plate 100 on the other side thereof, so that even though the elastic restoration force of the elastic member 300 is reduced due to long-term use, the base plate 100 can be kept in parallel to the connection parts 210 by means of the elastic restoration forces of the auxiliary elastic members 600.

Figure 7:
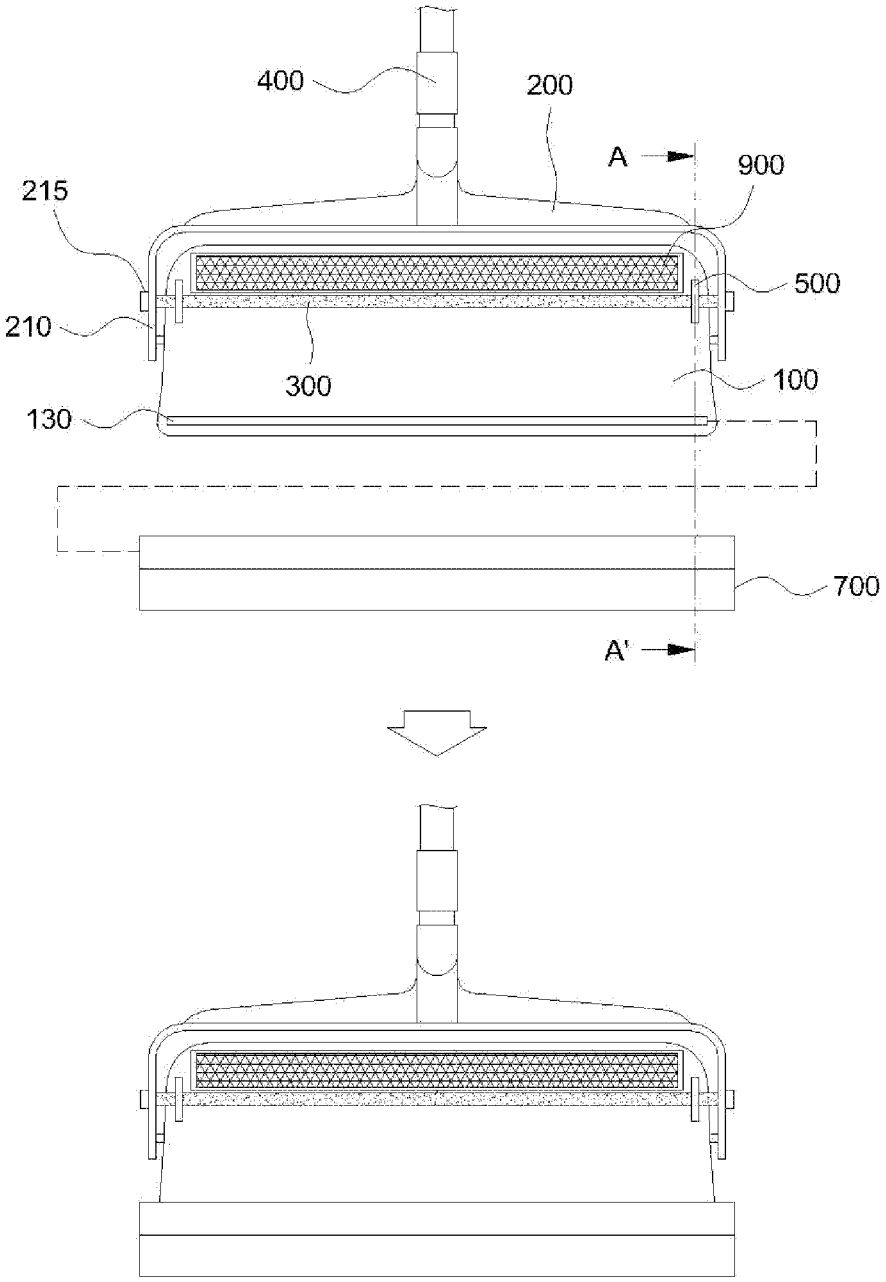
FIG. 7 is an exploded view showing the multifunctional push-pull mop according to the present invention that further includes an auxiliary cleaning plate.

Further, as shown in FIGS. 7 and 8, the base plate 100 has a rail groove 130 formed long in a longitudinal direction on one side thereof, and the multifunctional push-pull mop according to the present invention further includes an auxiliary cleaning plate 700 having a sharp sectional shape on the lower end portion thereof and a fitting part 710 disposed on top thereof and inserted or fitted to the rail groove 130.

In specific, the auxiliary cleaning plate 700 is additionally fitted to the base plate 100 that rotates to return to its original position by means of the elastic restoration forces of the auxiliary elastic members 600 and thus serves as a mop tool for removing dust from an insect screen or for attaching wall paper to a wall.

Figure 9:
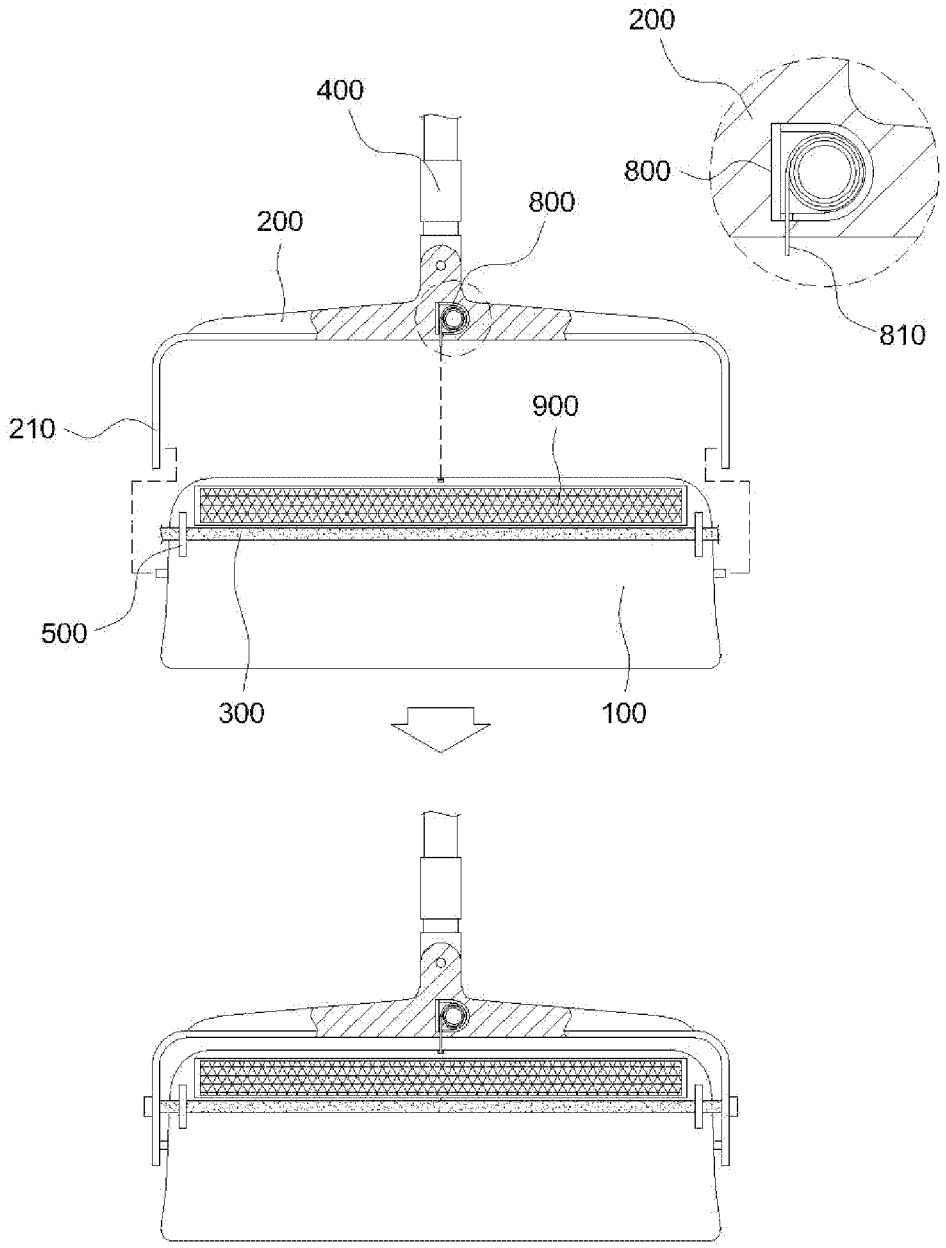
FIG. 9 is an exploded view showing the multifunctional push-pull mop according to the present invention that further includes a winding part.
Figure 10:
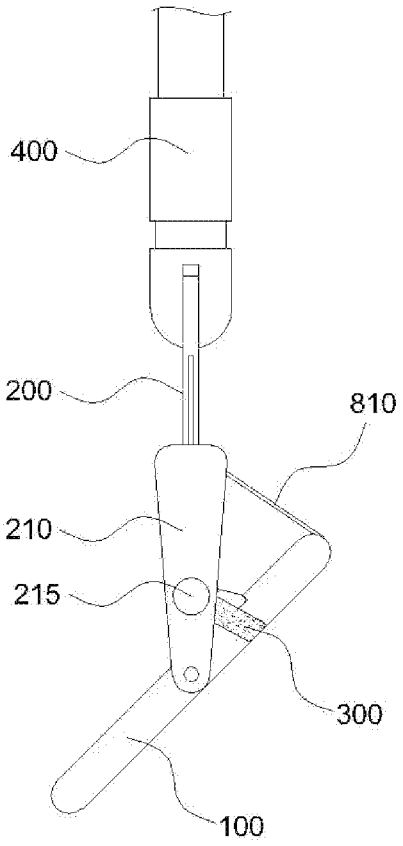
FIG. 10 is a perspective view showing a use state of FIG. 9.

Further, as shown in FIG. 9, the multifunctional push-pull mop according to the present invention includes a winding part 800 disposed on one side of the support member 200 to allow a line part 810 wound thereon to be continuously drawn and wound from and onto one side thereof, and the end portion of the line part 810 drawn from one side of the winding part 800 is connected to the center of top side of the base plate 100 kept in parallel to the connection parts 210 by means of the elastic restoration force of the elastic member 300.

As the base plate 100 rotates around the shafts, in specific, the winding part 800 desirably allows the line part 810 wound thereonto to be drawn from one side thereof, and further, the winding part 800 is configured to allow the line part 810 to be continuously wound automatically thereonto, so that when the base plate 100 rotates to return to its original position by means of the elastic restoration force of the elastic member 300, the winding part 800 winds the line part 810 thereonto to prevent the line part 810 from getting loose.

In more specific, the end portion of the line part 810 drawn from the winding part 800 is connected to the center of top side of the base plate 100 to thus hold the center of the base plate 100 rotating around the shafts connected to the connection parts 210, so that the base plate 100 can rotate more stably.

Figure 11:
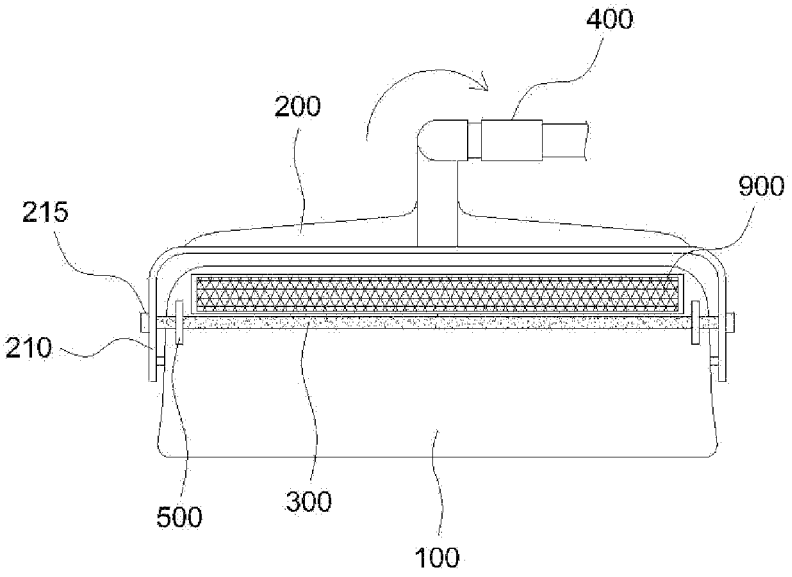
FIG. 11 is a perspective view showing a use state of the multifunctional push-pull mop according to the present invention.
Figure 12:
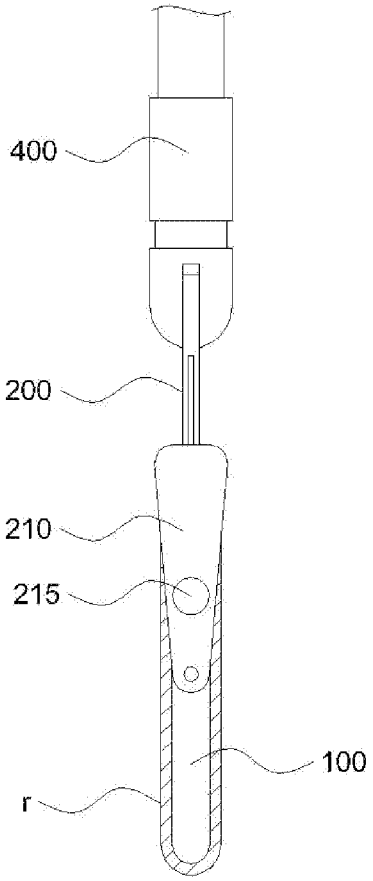
FIG. 12 is a perspective view showing another use state of the multifunctional push-pull mop according to the present invention.

Further, as shown in FIGS. 11 and 12, the multifunctional push-pull mop according to the present invention includes Velcro tapes 900 attached to the top and underside surfaces of the base plate 100 to allow the cleaning cloth r to be selectively coupled and separated thereto and therefrom, and the handle bar 400 is shaft-coupled to the top center of the support member 200 in such a manner as to vertically rotate around the shaft.

In specific, the Velcro® tapes 900 serve to selectively couple and separate the cleaning cloth r having the structure attached thereto to and from the top and underside surfaces of the base plate 100.

If necessary, further, a portion of the handle bar 400 that is close to the support member 200 is grasped by the user, so that an angle between the handle bar 400 and the support member 200 can be easily adjusted.

Figure 13:
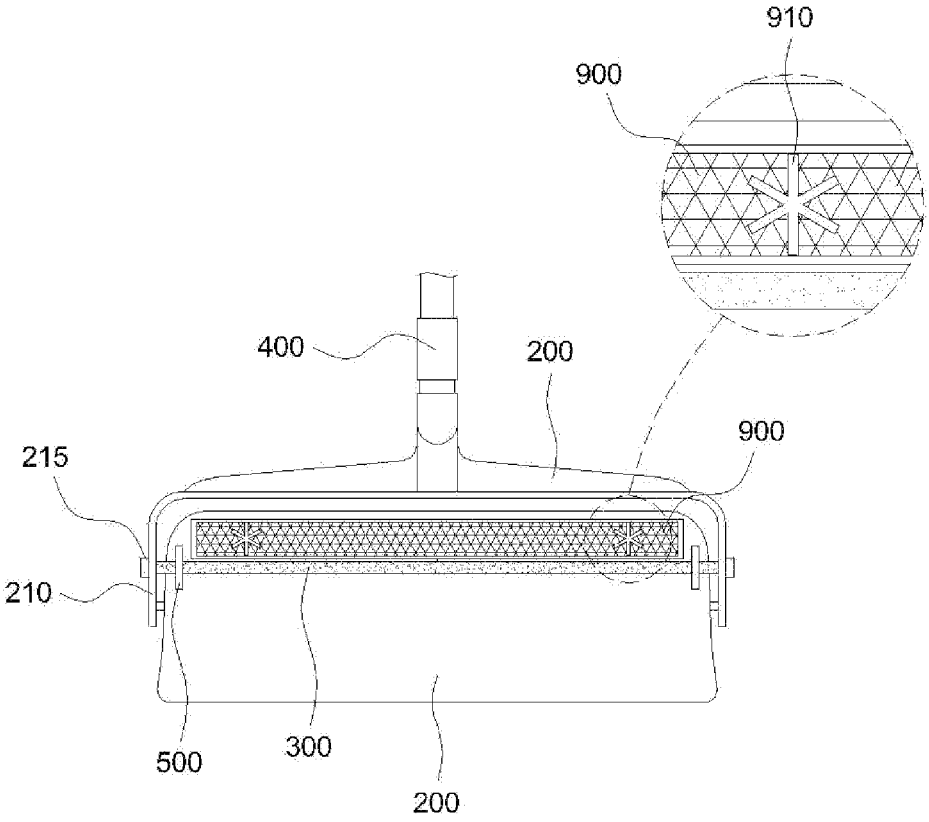
FIG. 13 is a front view showing a fitting slit of a Velcro tape of the multifunctional push-pull mop according to the present invention.

Further, as shown in FIG. 13, each Velcro® tape 900 has fitting slits 910 formed thereon to fittedly fix a cleaning cloth c thereto, and a portion of the base plate 100 that is located correspondingly to the fitting slits 910 is made of a rubber material.

In specific, the fitting slits 910 serve to fit the cleaning cloth c having no structure attached to the Velcro tapes 900 thereto and to thus fix the cleaning cloth c to the top and underside surfaces of the base plate 100.

According to the present invention, the multifunctional push-pull mop can perform its inherent function of cleaning indoor and outdoor places through tree cleaning cloth attached thereto, and when the mop moves by the user to clean the given place, further, the base plate to which the cleaning cloth attached is fixed by the elastic member to prevent the base plate from rotating around the shafts, thereby enabling the user to distinguish the top and underside surfaces of the base plate. If the base plate rotates by the force applied by the user to come into close contact with the floor, wall, ceiling, or the like, further, the base plate can be firmly brought into close contact with the floor, wall, ceiling, or the like by means of the elastic restoration force of the elastic member, and while the base plate is rotating around the shafts, further, the base plate can easily clean the curved wall or column through the returning force applied from the elastic member thereto, thereby providing many conveniences for the user.

The invention claimed is:

1. A multifunctional push-pull mop comprising:

a base plate configured to allow a cleaning cloth to be selectively detachably attached to one side of outer surfaces of the base plate;

a support member having connection parts bent and extended away from two ends of the support member in such a manner as to be coupled to shafts disposed on two ends of the base plate to allow the base plate to be rotatable around the shafts, and a handle bar coupled to a top center of the support member and adapted to be grasped by a user; and an elastic member made of an elastic material and connected to the connection parts and the base plate to allow the base plate rotating by means of shaft-coupling to the connection parts to be kept in parallel to the connection parts by means of an elastic restoration force generated from the elastic member, wherein the base plate has insertion grooves extending in a longitudinal direction of the base plate and on top and underside surfaces of the base plate, the insertion grooves receiving the elastic member, and the connection parts have fixing members configured to selectively fix and separate two ends of the elastic member to and from the connection parts, so that the elastic member is inserted into the insertion grooves to surround the top and underside surfaces of the base plate, and the two ends of the elastic member are fixed to the connection parts by the fixing members.

2. The multifunctional push-pull mop according to claim 1, further comprising escape prevention members disposed on one side of respective insertion grooves to prevent the elastic member inserted into the insertion grooves from escaping outwardly from the insertion grooves.

3. The multifunctional push-pull mop according to claim 1, further comprising auxiliary elastic members made of an elastic material, wherein each of the auxiliary elastic members has one end connected to one of the connection parts, and another end connected to the base plate so that the base plate rotating through the shaft-coupling to the connection parts is kept in parallel to the connection parts by elastic restoration forces generated from the auxiliary elastic members.

4. The multifunctional push-pull mop according to claim 1, further comprising an auxiliary cleaning plate having a triangle sectional shape on a lower end portion of the auxiliary cleaning plate and a fitting part disposed on an upper portion of the auxiliary cleaning plate and inserted or fitted to a rail groove extending in a longitudinal direction of the base plate on the one side of the outer surfaces of the base plate.

5. The multifunctional push-pull mop according to claim 1, further comprising a winding part disposed on one side of the support member, and a line part wound on the winding part, the line part including a first end portion connected to the winding part and a second end portion connected to a top center of the base plate, wherein the line part is configured to be drawn and wound from and onto the winding part in parallel to the connection parts by means of the elastic restoration force of the elastic member.

6. The multifunctional push-pull mop according to claim 1, further comprising tapes attached to top and underside surfaces of the base plate to allow the cleaning cloth to be selectively coupled and separated thereto and therefrom, the handle bar being shaft-coupled to the top center of the support member in such a manner as to vertically rotate around the shafts.

* * * * *